US012264670B2

(12) United States Patent
Schöning

(10) Patent No.: US 12,264,670 B2
(45) Date of Patent: Apr. 1, 2025

(54) PUMP CLOSURE

(71) Applicant: ISG Innovative Systems GmbH, Dortmund (DE)

(72) Inventor: Makus Schöning, Dortmund (DE)

(73) Assignee: ISG Innovative Systems GmbH, Dortmund (DE)

( * ) Notice: Subject to any disclaimer, the term of this patent is extended or adjusted under 35 U.S.C. 154(b) by 311 days.

(21) Appl. No.: 17/756,600

(22) PCT Filed: Nov. 24, 2020

(86) PCT No.: PCT/EP2020/083186

§ 371 (c)(1),
(2) Date: May 27, 2022

(87) PCT Pub. No.: WO2021/105110

PCT Pub. Date: Jun. 3, 2021

(65) Prior Publication Data

US 2023/0003217 A1 Jan. 5, 2023

(30) Foreign Application Priority Data

Nov. 29, 2019 (DE) ..... 20 2019 106 655.5

(51) Int. Cl.
*F04B 53/22* (2006.01)
*F04B 43/02* (2006.01)
*F04B 53/16* (2006.01)

(52) U.S. Cl.
CPC ..... *F04B 53/22* (2013.01); *F04B 43/02* (2013.01); *F04B 53/16* (2013.01)

(58) Field of Classification Search
CPC ..... F04B 45/00; F04B 45/04; F04B 45/041; F04B 45/043; F04B 45/045; F04B 45/047;
(Continued)

(56) References Cited

U.S. PATENT DOCUMENTS 595,290 A * 12/1897 Dowman ..... E05B 63/128 292/169.14
5,669,595 A 9/1997 Bytheway
(Continued)

FOREIGN PATENT DOCUMENTS

CN 203549210 U 4/2014
CN 205244058 U 5/2016
(Continued)

OTHER PUBLICATIONS

Author: NBK Title: What are clamp levers? Date accessed (mm/dd/yyyy): Jun. 10, 2024 Date published: Sep. 11, 2017 Link: https://www.nbk1560.com/en-US/resources/machine_element/article/clamplever-about/ (Year: 2017).*
(Continued)

*Primary Examiner* — Kenneth J Hansen
*Assistant Examiner* — Chirag Jariwala
(74) *Attorney, Agent, or Firm* — Price Heneveld LLP

(57) ABSTRACT

A diaphragm pump includes a pump head, a pump drive, a socket formed on the pump head configured to be releasably fixed to a mounting formed on the pump drive via a rotary closure, wherein the rotatory closure includes a securing device that includes a pushrod which is received in the mounting and is configured to be biased by a spring via a lever and engages in a positive-locking manner into a bore formed on the socket for locking.

20 Claims, 5 Drawing Sheets

(58) Field of Classification Search
CPC ..... F04B 17/03; F04B 17/06; F04B 35/04; F04B 35/06; F04B 39/14; F04B 53/16
USPC ..... 417/360
See application file for complete search history.

(56) References Cited

U.S. PATENT DOCUMENTS

| | | | | |
|---|---|---|---|---|
| 2011/0070107 | A1 | 3/2011 | Meza et al. | |
| 2015/0110652 | A1 | 4/2015 | Hoshi et al. | |
| 2016/0025086 | A1* | 1/2016 | Meza | F04B 53/22 417/313 |
| 2018/0291882 | A1 | 10/2018 | Algawi et al. | |

FOREIGN PATENT DOCUMENTS

| | | | |
|---|---|---|---|
| CN | 106662091 | A | 5/2017 |
| DE | 1784763 | U | 3/1959 |
| DE | 1959087 | A1 | 5/1971 |
| DE | 8624525 | U1 | 7/1987 |
| DE | 202006020237 | U1 | 3/2008 |
| DE | 102010024962 | A1 | 12/2011 |
| DE | 102014013779 | A1 | 3/2016 |
| GB | 15210 | | 6/1912 |
| GB | 2478007 | A | 8/2011 |
| WO | 0135015 | A1 | 5/2001 |
| WO | 2016007614 | A1 | 1/2016 |

OTHER PUBLICATIONS

European Patent Office; International Search Report; Mar. 9, 2021; entire document.
European Patent Office; Office Action; Jan. 23, 2024; entire document.
National Intellectual Property Adminstration of the People's Republic of China; Notification of Second Office Action; Apr. 10, 2024; entire document.

* cited by examiner

PUMP CLOSURE

BACKGROUND OF THE INVENTION

The invention relates to a pump, in particular a diaphragm pump having a pump head and a pump drive.

Pumps, in particular diaphragm pumps for pumping and metering liquids, are used in a wide variety of designs. High demands are placed on such diaphragm pumps, in particular for applications in the health and research sectors. In particular, such diaphragm pumps are used in the pharmaceutical sector for producing drugs but are also used in chemical engineering and biotechnology. It is known that the production of drugs in the pharmaceutical industry is a very cost-intensive sector and so it is desirable in the field of the cleaning of diaphragm pumps to achieve time savings predominantly with the aim of reducing costs. The production costs of diaphragm pumps are also very high by reason of the high sterility requirements, as the diaphragm pumps are basically made of stainless steel and have to be cleaned after each process test, as the diaphragm pumps are basically made of stainless steel and have to be cleaned after each process test, and so it is desirable to reduce the costs in the production of the pump elements. The pump head which is fixed to the drive must be completely cleaned regularly after each liquid run, which means that the pump head must be emptied of residue and made sterile before a new batch of drugs can pass through the unit. This means that e.g. after a test run for a specific drug several days and even further time-intensive cleaning steps are required in order to complete new test runs with the same unit. The costs for the cleaning procedure alone are very high because cleaning agents, staffing costs and considerable expenditure of time and the like must be provided.

PRIOR ART

In order to overcome this problem, pumps have been developed, of which the pump head is releasably or removably fastened to a drive assembly.

Pumps, in particular those in which a pump head is releasably fastened to a pump drive, are generally known. For instance, US 2011/0070107 A1 discloses a pump having a pump head as a single-use article, wherein the pump head has inlet and outlet openings and is connected to a motor so that the liquid to be pumped can be transported through the inlet into the pump head and then to the outlet. The pump head housing is fastened to a motor connecting piece via four connecting screws, wherein the motor connecting piece is attached to the motor, in turn, via four connecting screws. The attachment of the pump head to the pump head housing is complicated and protracted and so a tool is initially required in order to release or fasten the connecting screws. The releasing of four connecting screws, the arranging of the pump head and the re-screwing thereof to the drive takes time and thus, with each new test run, each new process section or each new batch of drugs, a cost is generated by reason of the loss of time which is reflected negatively in the inherently very high costs in the pharmaceutical sector. Moreover, this procedure is conducive to germ formation, i.e. it is not very hygienic, in particular because it requires a tool for assembly and there is a risk that the four screws are not completely sterile.

A diaphragm pump is known from DE 20 2006 020 237 U1, wherein this consists of a pump head connected to a drive and having a plurality of pump chambers which are each sealed with respect to a drive chamber by means of a pump diaphragm, wherein the respective pump diaphragm is connected via an allocated pump element to a swash plate arranged in the drive chamber and can be set into a periodic axial pumping movement by means of a swashing movement of the swash plate. The pump head is divided into a replaceable diaphragm head part and a drive head part which is fixedly connected to the drive, wherein the swash plate can be connected via a ball bearing to a spigot-tilted with respect to a longitudinal axis—of a drive shaft connected to the drive. The diaphragm housing part and the drive chamber part of DE 20 2006 020 237 U1 can be screwed together using screws. Even in this case, the disadvantage resides in the complex and time-consuming screw connection which leads to time delays in e.g. drug production every time the membrane head part is changed. In addition, as with the US document above, a tool is required to release the screws, which may not be immediately available, and therefore even greater time delays have to be accepted. A further disadvantage of the screw connection is that it is released in the event of high pressure fluctuations, shocks or vibration movements and thus results in a sealing tightness problem in the pump chambers and the inlet and outlet chambers. Sterility problems, as mentioned further above, are also associated with this.

Finally, diaphragm pumps are also known which have a pump housing, to which a single-use cell can be releasably fixed (e.g. DE 10 2014 013 779 A1). The single-use cell can be fixed to the pump housing without tools by means of a clamping device. The clamping device has a manually operable pivot lever, of which the pump housing is considered to be pivotable and can be moved between a release position and a holding position. The pump housing is designed in such a manner that it can be divided and has at least two housing parts, between which the single-use cell can be releasably clamped. The two housing parts can then be moved by means of the clamping device between a holding position close to each other and a release position spaced apart from each other. The pivot lever is designed in the manner of a bracket. In order to introduce the single-use cell, the clamping device must be open and must be located in its release position, in which release position the position designation "OFF" can be seen on a cross web of the bracket-shaped pivot lever. The single-use cell is placed onto a pre-positioning surface and inserted into the opening which in the release position is formed between the housing parts. Then, the pivot lever of the clamping device is pivoted from the "OFF" position towards the "ON" position. The pivot lever can be pivoted about a pivot axis.

This already signifies progress compared to the prior art mentioned above, as no tool has to be used. However, the closure technique can also be released in this case, in particular this closure mechanism quickly leads to wear after repeated use because the clamping device can become loosened, bent or deformed by reason of the shocks or vibrational movements acting thereon. In particular, the attachment of a clamping device with a bracket-like pivot lever does not meet the hygiene requirements in sterile environments in the sector of manufacturing chemistry and biotechnology, in particular in the sector of drug production or sterile liquid transport. Since the clamping device must be attached to the connection between the single-use cell and the pump housing at least at two positions to ensure secure fastening, at least two clamping devices, preferably four clamping devices, are located outside the pump, the surfaces and in particular the closure elements of which quickly become contaminated and besieged with fungal spores or bacteria. The cleaning of such clamping devices is also difficult, since the connection points of the bracket-like pivot levers to the rest of the closure device are hardly accessible for thorough cleaning. In addition, improper handling can quickly result in injuries caused by the clamp system.

Therefore, the object of the invention is to improve the hitherto known pumps, in particular diaphragm pumps of the type described in the introduction, in such a way that the pump head can be releasably fastened to the pump drive easily and in just a few steps and can be changed quickly, so that considerable time savings are possible e.g. in the production of drugs in the pharmaceutical industry. Furthermore, the closure mechanism is to be easy to handle, in particular the fastening between the pump head and the pump drive is intended to produce a fixed closure which cannot be released by itself, is preferably self-locking, and in particular withstands high pressure fluctuations, shocks and vibration movements which arise regularly, without impairing the function, the material or the running time of the pump. In particular, the pump is to meet the hygienic requirements for sterile environments and be so reduced in its components on the outer region that hardly any or no dirt, fungal spores, bacteria or the like can be deposited on the externally arranged closure device. Furthermore, the closure device is to be stable and configured in such a way that it can be cleaned quickly and easily as well as thoroughly, and in particular that a high level of sterility is ensured.

SUMMARY OF THE INVENTION

According to the invention, the pump head is releasably fastened to the pump drive. The fastening is effected without tools via a socket which is formed on the pump head and is releasably received in a mounting formed on the pump drive, and moreover via a rotary closure. The rotary closure is provided with an additional securing device which locks the pump head to the pump drive, preferably via a self-locking mechanism and likewise without tools. The locking can only be released manually, and so it can no longer be released by rotating the rotary closure back between the pump head and the pump drive in the event of shocks or vibration movements caused by the pump. The rotary closure thus releasably secures the socket of the pump head in the mounting of the pump drive, wherein the rotary closure can be additionally locked via a securing device. The locking is effected by a pushrod which is received in the mounting and, for locking purposes, engages in a positive-locking manner into at least one bore formed on the socket. The pushrod can be biased by means of a spring via a lever. The spring-loaded pushrod ensures self-locking of the rotary closure as soon as the rotary closure is located in its end position. Instead of the at least one bore formed on the socket or bore on the socket side, a plurality of bores are preferably provided on the socket, in particular four bores on the socket side, wherein the pushrod which can be biased latches into the at least one of the preferably plurality of bores in the end position of the rotary closure, depending upon the requirement of the orientation of the pump head on the pump drive. It is advantageous that the pushrod only has to be biased manually, but then is locked automatically at the end of the rotary movement, i.e. in the end position of the rotary closure, and moreover by reason of the biased spring when the pushrod is oriented with the socket-side bore, such that the pushrod latches into the at least one socket-side bore. In an expedient manner, the outer end of the pushrod is provided with a lever thereon, preferably in the form of a rotary vane or pivot vane, via which the spring can be biased.

According to a particular embodiment, the rotary closure is produced by means of a push-in rotary connection, wherein for this purpose at least two latching lugs engage into at least two latching grooves which are designed in a complementary manner to one another. The at least two, preferably four, latching lugs are preferably formed on the socket and engage into the at least two, preferably four, particularly preferably bayonet-like latching grooves which are preferably formed on the mounting. The latching lugs are designed in a complementary manner to the latching grooves. The latching lugs preferably on the socket side are introduced into the latching grooves preferably on the mounting side, in order to fasten the pump head to the pump drive, wherein the respective latching lug reaches its end position in the respective latching groove via a rotary movement. The pump head is thus releasably fastened to the pump drive. The advantage with this rotary closure is that the pump head can be fixed to the drive quickly and without additional means, in particular without tools, with only a small rotatory force. This ensures quick assembly and disassembly of the pump, in particular replacement of the pump head. Preferably, the latching grooves on the inner wall of the mounting are designed as slot-like recesses, wherein the inner wall in the region of the latching grooves is reduced compared to the normal wall thickness. The depth of the latching grooves corresponds advantageously to the depth of the latching lugs. The latching lugs are complementary, i.e. in particular formed on the outer wall of the socket, in such a way that they can be inserted or introduced into the latching grooves or slot-like recesses. This closure technique is static and dimensionally stable. In addition, this is not resiliently secured with a clamp or retaining bracket, which leads to dimensional stability.

In a particularly preferred embodiment of the pump, the at least two latching grooves are arranged along the inner circumference of the mounting at a 180° angle, wherein the at least two latching lugs are likewise formed along the outer circumference of the socket at a 180° angle to each other and are oriented in a complementary manner to the latching grooves. In the case where the rotary closure is formed from four latching grooves and four latching lugs, the four latching grooves are arranged along the inner circumference of the mounting at a 90° angle to each other and the four latching lugs are arranged along the outer circumference of the mounting likewise at a 90° angle, and moreover with the latching lugs oriented in a complementary manner to the latching grooves. The advantage is that with the four rotary closure elements, i.e. four latching lugs and four latching grooves, an extremely stable fixing of the pump head to the pump drive is achieved.

In a preferred embodiment, the respective latching groove is formed from a transverse slot and a longitudinal slot on the inner wall of the mounting. The transverse slot extends perpendicularly to the circumference of the mounting and is open towards the pump head or at the edge of the mounting and on the inner wall of the mounting, so that the latching lug on the socket side can be introduced through the transverse slot opening at the edge of the mounting and transferred along the bottom of the transverse slot into the longitudinal slot. Advantageously, the transverse slot is chamfered on one of its vertical side walls in such a way that an inclined surface is formed towards the first longitudinal side of the longitudinal slot closest to the mounting edge. The insertion opening or transverse slot opening is thereby enlarged towards the inside, i.e. towards the second longitudinal side of the longitudinal slot opposite the first longitudinal side, which is designed as an extension to the bottom of the transverse slot, such that the latching lug can be introduced into the longitudinal slot as far as a stop in the end position without frictional resistance. The transverse slot is thus provided at the edge of the mounting with an opening, the length of which expediently corresponds at least to the length of the latching lug and via which the latching lug can be introduced into the transverse slot of the mounting, wherein the transfer into the longitudinal slot is not effected via a corner edge formed by the transverse slot and longitudinal slot, but instead via the chamfered surface which is formed between the insertion opening and the first longitudinal side of the longitudinal slot closest in parallel with the edge of the mounting.

For the purpose of easily introducing the latching lugs into the latching grooves, it is expedient that the latching lugs are elongate in the direction of the circumference of the socket and are rounded at least at one of their face ends. This reduces the friction factor during insertion and facilitates insertion into the transverse slot and then transfer into the longitudinal slot. Advantageously, the opposite face-side end of the elongated latching lugs is angular, although another shape is also possible as an alternative. In a particularly preferred manner, the rounded face side of the latching lug is provided at the end of the latching lug which is introduced into the longitudinal slot via the inclined surface. The advantage of this is that with little force and by reason of the reduced friction factor, the latching lug can be quickly and easily transferred via the inclined surface into the longitudinal slot as far as the stop.

The additional securing device ensures that the rotary closure is locked. As soon as the rotary closure is in its end position, the bore for the pushrod engagement, which is provided on the socket side, is oriented with the pushrod. When the pushrod is biased and is in this orientation, it springs into the socket-side bore. Releasing the rotary closure and thus the pump head from the drive by rotating it back is blocked or inhibited by the securing device, in particular the locking between the pushrod and the bore. In an expedient manner, self-locking is effected. In an advantageous manner, the pushrod automatically engages into the bore as soon as the pushrod and the socket-side bore are oriented with one another. In a first step, the pump head is fastened to the pump drive, and moreover via the rotary closure, wherein in a second step the pushrod latches into the socket-side bore when the rotary closure is rotated to its end position. The rotary closure is then in its end position when a face-side end of the latching lugs abuts against the end of the longitudinal slot facing away from the transverse slot. In an advantageous manner, the pushrod engages automatically into the bore at the end of the push-in rotational movement between the pump head and pump drive in the locking position and, by reason of the positive locking, prevents the pump head from being released from the pump drive by back-rotation, and moreover even when large pulsation loads occur. Since the locking is effected automatically in the end position of the rotary closure, in particular at the end of push-in rotational movement, the mounting of the pump head on the pump drive is very simple, can be performed quickly and is uncomplicated.

In a further embodiment, the pushrod is mounted in a first sleeve. The first sleeve is fixed in a bore in the mounting extending perpendicularly to the axial direction of the pump, the so-called mounting-side bore, preferably via a thread. In addition to the first sleeve, the securing device expediently has a second sleeve which is mounted in the first sleeve for accommodating the spring. In an advantageous manner, a nut on the outer wall of the mounting secures the first sleeve in the vertical bore of the mounting. The first sleeve protrudes preferably in part into the bore of the mounting and is surrounded on the outer side of the mounting by the nut, wherein preferably a further protrusion of the outer-side end of the first sleeve remains. The spring is mounted in the second sleeve in such a way as to be able to be biased, wherein the spring is delimited at its outer-side end by means of a first stop projecting from the second sleeve at its outer-side end, and at its inner end by means of a second stop formed by a thickened portion or a bead-like protrusion, circumferentially of the pushrod or pushrod pin. The pushrod pin is slidably mounted in the first and second sleeve, wherein the movement play of the pushrod pin is specified by the spring and its limiting stops. The arrangement and spring loading of the pushrod permits the self-locking of the securing device and the automatic locking of the rotary closure.

In an expedient manner, the first sleeve is provided with an inclined ramp formed at the outer end of the sleeve, such that the pushrod can be biased to a first position by rotating a lever, preferably a rotary vane, provided at the outer end of the pushrod. In turn, by counter-rotating the lever to a second position, preferably by 180°, the biasing can be released. Only in the end position of the rotary closure is the biased pushrod oriented with the socket-side bore and engages into same. Beforehand, the spring continues to be compressed by lying against the outer wall of the mounting. Counter-rotation of the lever from the first position to the second position causes the pushrod pin to be withdrawn from the socket-side bore in such a way that the inwardly directed end of the pushrod pin latches completely out of the socket-side bore and is then located in the mounting-side threaded bore. The locking bolt or the securing device is then thus open. Therefore, in order to release the locking it is necessary to rotate only the lever or the rotary vane by 180° from the first position to the second position.

In an expedient manner, the locking functions in such a manner that the latching lugs of the pump head are inserted into the transverse slot, after which the securing device is adjusted in such a manner that the spring accommodated therein is biased. This is effected expediently by rotating the closure lever of the securing device, which was previously located in the second position, from the second position to the first position, preferably by 180°. During this rotational movement, the lever of the security device is displaced via the inclined ramp of the first sleeve and biases the spring. The inner end of the pushrod, i.e. the end of the pushrod located in the mounting, strikes the outer wall of the socket, which is why the spring remains compressed. Only at the end of the rotational movement of the socket in the mounting and thus the insertion of the latching lugs into the longitudinal slot of the latching grooves as far as to the end position is the inner-side end of the pushrod displaced along the outer wall of the socket as far as to the socket-side bore, into which the pushrod latches and therefore the rotary closure is additionally locked. The closure lever can then be rotated from the first position to the second position, preferably by 180°, to remove the pump head, such that the pushrod is released from the socket-side bore and the pump head can then be removed from the pump drive.

In a particularly preferred embodiment of the invention, the inclined ramp is formed by a bevel cut on the first sleeve protruding from the mounting.

In an expedient manner, only one securing device is arranged on the mounting, preferably between two latching grooves. Because in the mounted position of the pump head with the pump drive no elements of the rotary closure and only one securing device are arranged on the outer side of the pump, a high level of sterility is ensured and at the same time a very secure closure is achieved.

In an expedient manner, the securing device is located close to a latching groove, preferably in the extension of the longitudinal slot, wherein the mounting-side bore of the securing device does not lead through the longitudinal slot or the transverse slot, but instead at a small spaced interval from the end of the longitudinal slot designed as a stop for the latching lug. In a complementary manner thereto, the socket-side bore is formed close to the rounded end of a latching lug and in its longitudinally oriented extension on the socket side. The bore on the socket can be designed as a through-bore, but also as an engagement opening which is delimited with a stop formed by the inner wall of the socket. The advantage of this arrangement is that the locking is effected immediately after the push-in rotational movement of the socket in the mounting. If the spaced interval between the bores was greater with respect to the respective nearest latching groove or latching lug, the locking of the closure mechanism would take more time. This would not be expedient and would be disadvantageous in view of the desired time savings. Therefore, this arrangement of the bores at the small spaced interval with respect to the rotary closure means, i.e. to a closest latching lug and latching groove, is advantageous.

In an alternative embodiment, a plurality of securing devices can be provided on the mounting.

In a particular embodiment of the pump, the spaced interval between the socket-side bore and one of the latching lugs is at an angle of 1° to 44° along the socket circumference, particularly preferably at an angle of 5° to 30°. This also applies to the mounting-side bore in relation to the spaced interval with respect to the nearest latching groove or the stop of the "end position" at that location. The bore is expediently oriented in the circumferential line of the respective centre line of the rotary closure means, wherein the centre line of the longitudinal slot is decisive in the case of the latching groove. This results in reliable locking and a secure connection between the pump head and the drive, which also withstands high vibration forces and shocks.

The socket-side bores are preferably arranged at a 90° angle to one another and lead vertically from the socket outer wall into the socket inner wall. This arrangement allows the inwardly directed end of the pushrod to be securely received in the vertical bore. Since the socket-side wall thickness is preferably between 1.5 mm and 8 mm, in particular between 2 mm and 6 mm, particularly preferably between 3 mm and 5 mm, and the depth of the socket-side bore corresponds preferably to the wall thickness, this ensures stable depth engagement of the pushrod and thus secure locking. The locking is also break-proof by reason of the solid locking elements, which are preferably made of metal, particularly preferably stainless steel. It is possible to form the pump head itself from synthetic material, as in the case of EP 3 447 290 A1, but to form the socket, which is provided in accordance with the invention, and the mounting as well as the elements of the present securing device, from metal, particularly preferably stainless steel. Alternatively, it is possible and advantageous to form the components from synthetic material, as this makes them lighter and cost-effective to produce. This is advantageous because the pump head can be a single-use pump head.

In a particularly preferred embodiment of the pump, the rotary closure is a rotary latching closure.

BRIEF DESCRIPTION OF THE DRAWINGS

A preferred exemplified embodiment of the invention will be described hereinafter with the aid of the purely schematic drawings. In the drawings.

DETAILED DESCRIPTION OF THE PREFERRED EMBODIMENTS

Figure 1:
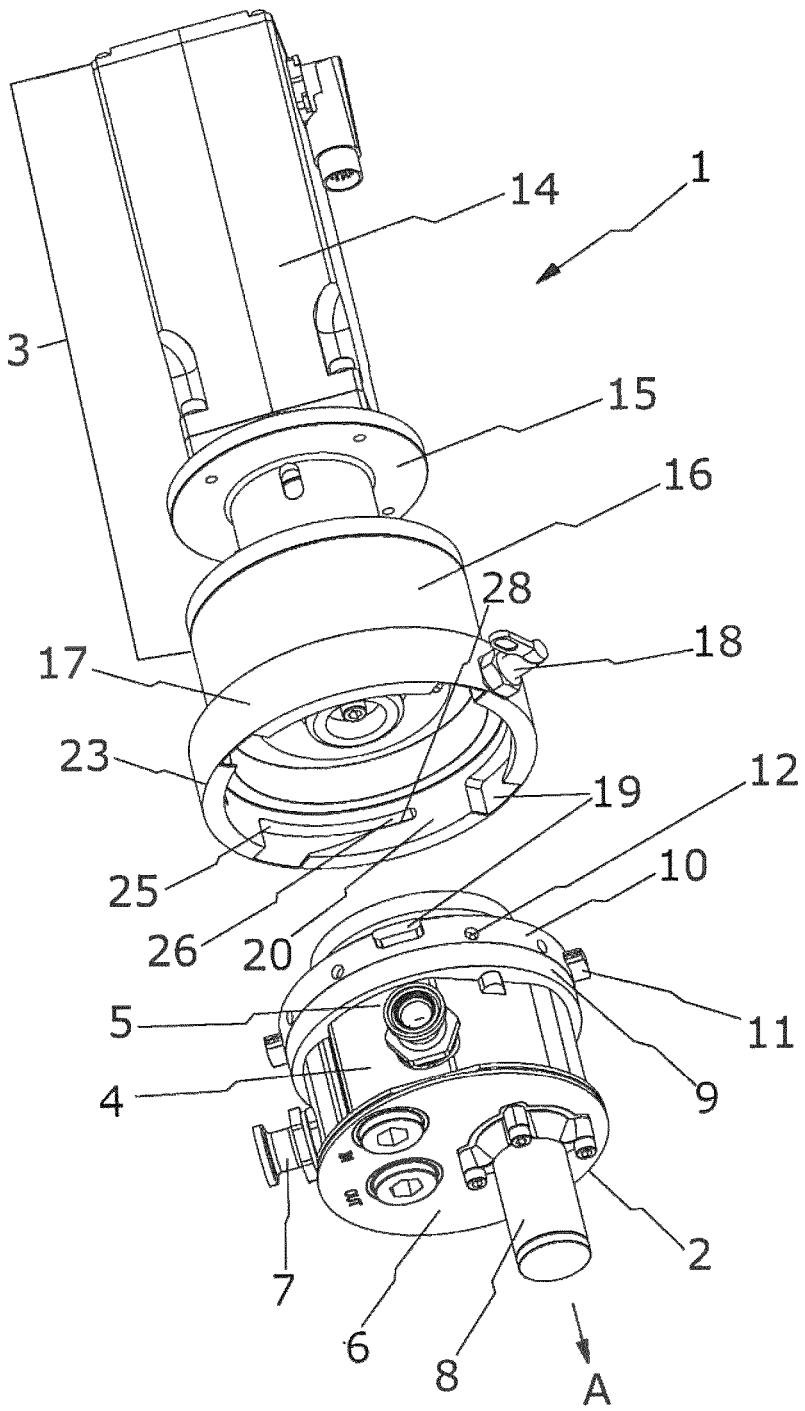
FIG. 1 shows a perspective view of a pump, in particular a diaphragm pump, formed from a pump head and a pump drive.

FIG. 1 shows a pump 1, in particular a diaphragm pump, which is formed from a pump head 2 and a pump drive 3. The pump head 2 which can be releasably fastened to the pump drive 3 is shown in a position released from the drive. The cylindrical pump head housing 4 is open at the top with preferably a lateral housing wall 5 and a bottom or housing bottom 6 which preferably closes at the bottom, wherein in the embodiment shown, connections 7 on two sides, at least one inlet and one outlet, are arranged. The connections 7 on the housing wall 5 are expediently spaced apart at a 90° angle to one another. In this embodiment, a relief valve 8 is formed at the bottom 6 of the pump head housing 4 for reducing work-induced or system-induced excess pressures, is preferably hermetically connected to the pump head housing 4 and enables constant flow conditions. The housing wall 5 of the pump head housing 4 closes off at the top with a housing ring 9. The housing ring 9 is thus arranged at the upper end of the pump head 2, opposite the bottom 6 of the pump head housing 4. A socket 10 is arranged on tis ring, is likewise formed in an annular manner and has at least two latching lugs 11 and at least one bore 12 (socket-side bore) on its outer side. The socket-side bore 12 is formed close to one of the latching lugs 11, preferably in the extension of the longitudinal direction of the latching lug 11, and close to its rounded face-side end 13. Alternatively, the bore 12 may be slightly offset with respect to the longitudinal direction of the latching lug 11. A plurality of bores 12, e.g. two or particularly preferably four bores 12 or eight bores 12, can also be provided on the socket side, wherein each of the bores 12 is provided close to one of the latching lugs 11 and the at least two bores 12 are spaced apart at a 180° angle to one another, the at least four bores 12 are spaced apart at a 90° angle to one another.

In the present embodiment of the pump head 2, four latching lugs 11 are provided which are each arranged at a 90° angle to one another along the socket circumference. The elongated latching lugs 11 are rounded in this case both at a first transverse-side end and at a second transverse-side end 13. Alternatively, it is possible for the latching lugs 11 to be rectangular in shape at a first transverse-side end and are rounded at a second transverse-side end 13. Therefore, both transverse-side ends do not have to be rounded. Preferably, at least one transverse-side end is rounded, wherein in this case the rotational direction of the closure specifies the selection.

The pump drive is formed from a drive head (not shown here), a drive housing 14, a flange 15 provided at the bottom of the drive housing and a drive chamber housing 16 located downstream, wherein a mounting 17 with a securing device 18 and a closure arrangement 19 is provided on the underside of the drive chamber housing 16. The closure arrangement 19 is formed on an inner wall 20 of the mounting 17 in such a manner that the latching lugs 11 provided on the socket 10 can be inserted therein and the pump head 2 can be releasably fastened to the drive by means of a rotational movement. The purpose of the securing closure 18 is to ensure that the rotary closure cannot be released when the pump 1 is running.

FIG. 1 shows through the perspective view that the rotary closure for connecting the pump head 2 to the drive is formed from the socket-side latching lugs 11 of the pump head 2 and the slot-like receptacles 21, preferably latching grooves on the inner wall 20 of the mounting 17. The slot-like receptacles 21, preferably latching grooves, are configured in such a manner that a transverse slot 22 protrudes vertically from the bottom to the top on the inner wall 20 into the mounting 17, wherein the wall thickness in the region of the latching groove or slot region 21 is minimised compared to the normal wall thickness of the mounting 17 outside the slot region. In this case, the wall thickness in the slot region 21 is preferably minimised or set back by 0.4 mm to 6 mm, preferably between 1.0 mm and 4 mm, particularly preferably between 1.5 mm and 2 mm, compared to the normal wall thickness of the mounting 17. In a particularly preferred embodiment, the depth of the slot region, i.e. the depth of the latching groove, is 1.52 mm. Preferably, the dimensions correspond in each case to the depth T of the latching lugs. The wall thickness of the mounting in the slot region is preferably between 1 mm and 2 mm and particularly preferably not more than 2 mm. The transverse slot 22 which extends in an axial direction A along the inner wall 20 of the mounting 17 is open towards the outside of the pump head 2, i.e. at the mounting edge 23, as an insertion opening 24 for receiving the latching lug 11 and is transferred at its inner bottom 25 into a longitudinal slot 26 which extends in parallel with the edge 23 of the mounting 17. One side of the transverse slot 22 has an inclined surface 27 which extends obliquely from the insertion opening 24 of the transverse slot 22 to the longitudinal side 28 of the longitudinal slot 26 closest to the mounting edge 23, thereby shortening the longitudinal slot 26 so that the latching lug 11 can be introduced more easily into the longitudinal slot 26 via the inclined surface 27. The additionally rounded front surface 13 of the latching lug 11 reduces the friction factor when the latching lug 11 is introduced into the latching groove 21 and the rotary closure requires only an extremely low force to close.

Figure 2:
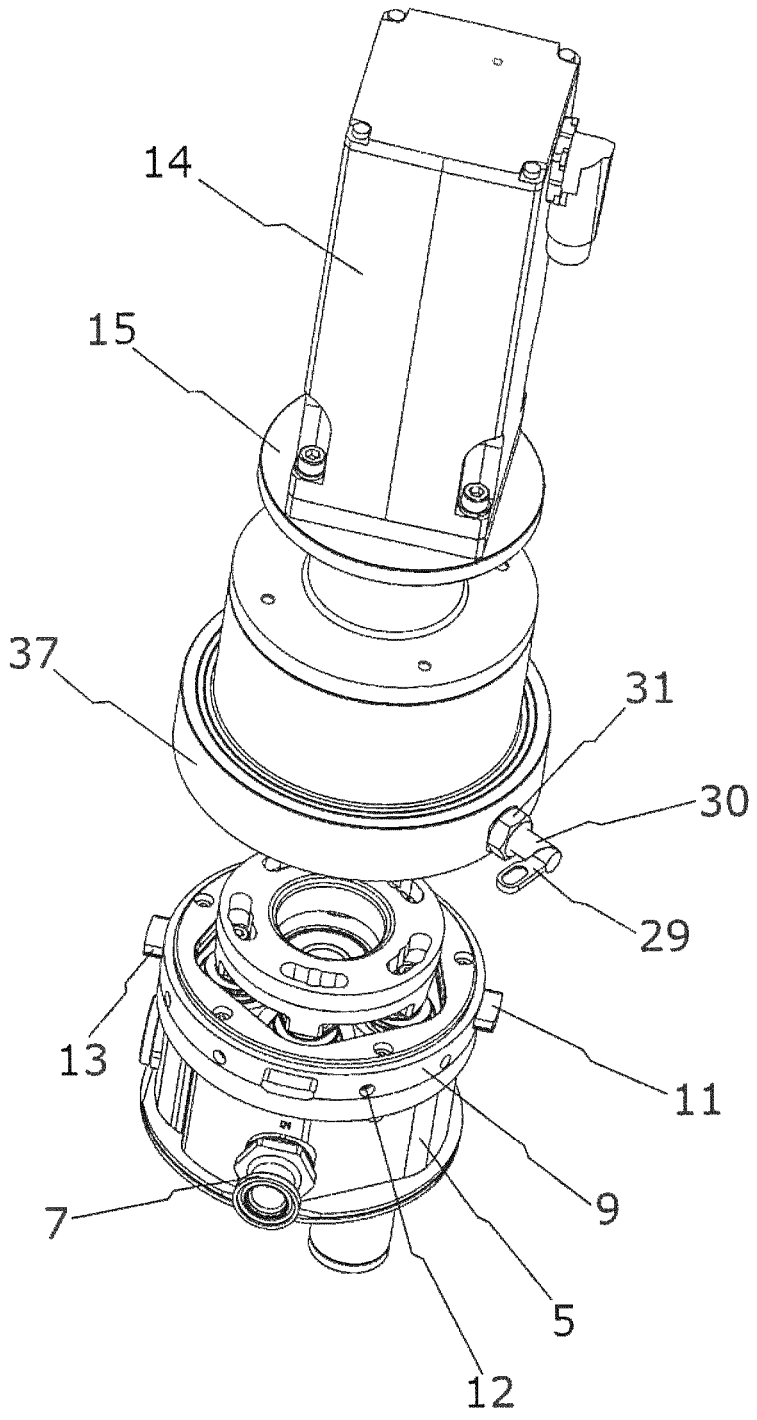
FIG. 2 shows a further perspective view of the pump shown in FIG. 1.

FIG. 2 shows an oblique plan view of the pump 1, in which the securing device 18 is clearly visible. FIG. 2 shows a closure lever 29, a first sleeve 30 and a nut 31 which together with other elements (not shown) form the securing device 18. In this embodiment, the closure lever 29 is designed as a rotary vane, although alternative designs are possible. The visible first sleeve 30 shows an inclined ramp 40. The first sleeve 30 is fastened to the mounting 17. In this case, the first sleeve 30 is provided with an external thread preferably on the mounting side, said external thread engaging into a corresponding internal thread of a bore 32 on the mounting (mounting-side bore 32). The nut 31 secures the threaded connection between the first sleeve 30 of the securing device 18 and the mounting-side bore 32. The external thread allows fine adjustment in the axial direction of the pushrod 42, in the socket-side bore 12.

FIG. 2 also shows three of the four latching lugs 11 which are formed on the outer side on the socket 10 of the pump head 2. In this view, the rounded transverse lateral surface 13 of the latching lugs 11 is also oriented in particular in a clockwise direction. It is thus also apparent from FIG. 2 that the embodiment of the pump 1 shown in this case has a pump head 2 which can be fastened by means of a left-rotation after insertion of the pump head socket 10 into the mounting 17, wherein the rounded transverse sides 13 of the latching lugs 11 are guided, after insertion via the insertion opening 24 into the transverse slot 22, via the inclined surface 27 into the longitudinal slot 26 as far as to an end position 33. Of course, the specific configuration of the latching lugs 11 can also be in the other clockwise direction such that the rounded transverse lateral surfaces 13 are provided in the clockwise direction and the complementarily formed transverse and longitudinal slots as well as the inclined surfaces 27 of the latching groove 21 in the mounting 17 are correspondingly complementary thereto.

A pushrod 34 (not shown here) which is received in the first sleeve 30 and a second sleeve 35 such that it can be biased via a spring 36 slides through the opening of the bore 32 in the mounting into the socket-side bore 12 when the rotary closure is in its end position, preferably when the pushrod 34 in the mounting-side bore 32 is oriented with the socket-side bore 12. Therefore, locking and thus self-locking of the rotary closure in the end position 33 are effected via the spring-loaded pushrod closure of the securing device 18.

Figure 3A:
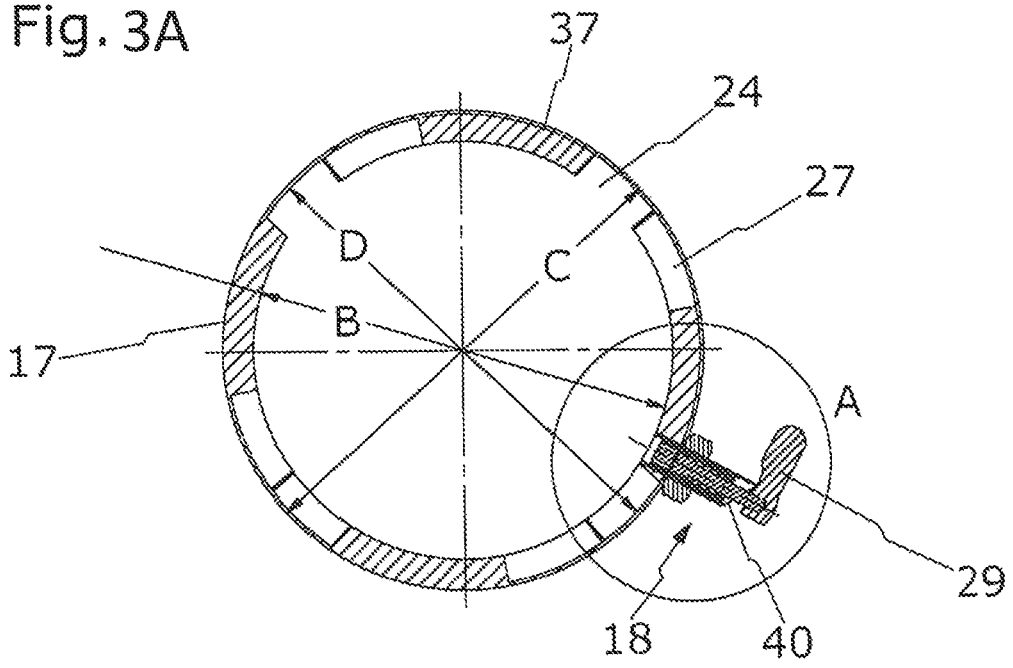
FIG. 3A shows a cross-section through the mounting on the pump drive, in particular through the securing device which is formed on the mounting and in which the locking is released.

FIG. 3A is a cross-section through the mounting 17 of the pump drive 3 and through the securing device 18 which is provided on the mounting 17. The mounting 17 is formed from a circumferential wall 37, of which the wall thickness in the region of the transverse and longitudinal slot is significantly minimised compared to the remaining wall thickness. The mounting 17 has four latching grooves 21, wherein the insertion opening 24 of the transverse slot 22 of each latching groove 21 is visible. The inclined surface or wedge surface 27, which obliquely connects one side of the transverse slot 22 to the longitudinal side 28 of the longitudinal slot 26 closest to the mounting edge 23 is shown without hatching. In FIG. 3A, the closure pushrod or locking bolt 34 is shown in the open position. The pushrod is received in a first sleeve 30. The first sleeve 30 is fastened in a vertical bore 32 in the mounting 17, preferably via a threaded connection. In this case, the first sleeve 30 has an external thread which is expediently formed only in the region of the mounting, and the vertical bore 32 in the mounting has an internal thread. A second sleeve 35 is provided in the first sleeve 30 for accommodating the spring 36. The pushrod 34 has a thickened portion 38 in the form of a bead slightly above its end protruding into the mounting, said bead lying movably against the inner wall of the second sleeve 35. The spring 36 is arranged above this thickened portion 38 around the pushrod 34, wherein the second sleeve 35 forms, at its outer end, a stop 39 for the spring 36. Arranged at the outer end of the pushrod 34 is a lever 29 for biasing the spring 36. The spring 36 can be biased via the lever 29 and an inclined ramp 40 on the first sleeve 30.

Figure 3B:
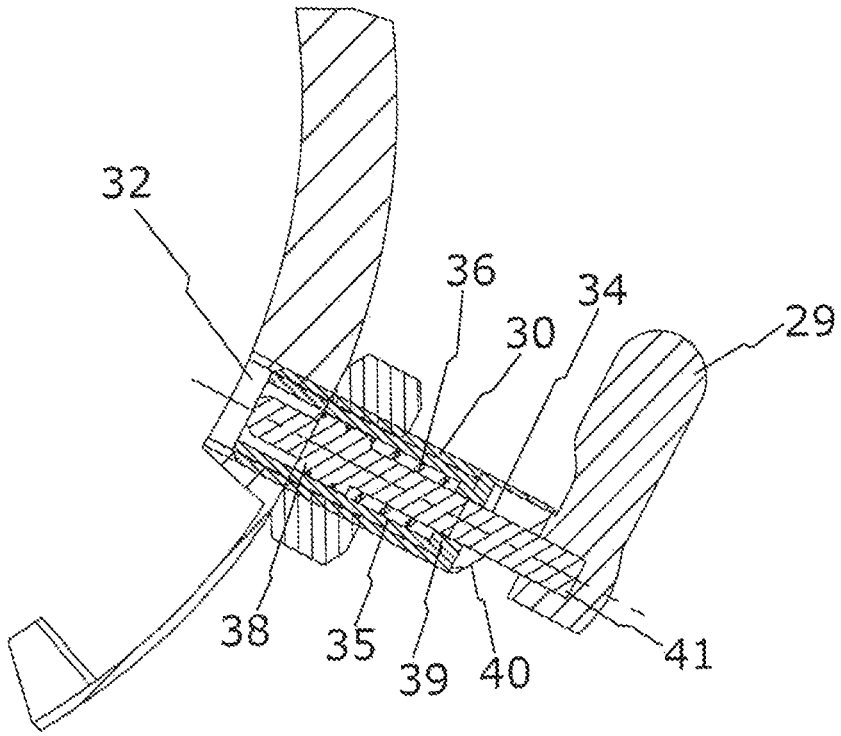
FIG. 3B shows an enlarged view of the securing device circled in FIG. 3A and marked by reference sign A.

FIG. 3B shows the inclined ramp 40 which is formed on the first sleeve 30. At the other end 41 of the pushrod, a lever 29 is provided, preferably as a rotary vane. It is located in a second position, i.e. in the open position of the locking bolt 34. Therefore, the pushrod 34 is not yet latched in the socket-side bore 12 in such a manner that the rotary closure is locked. The rotary vane can be rotated from its second position, as shown in FIG. 3B, to a first position, as shown in FIG. 4B, via a preferably 180° rotation. By means of the rotation to the first position, the pushrod 34 can be biased via the spring 36. As soon as the mounting-side bore 32 and the socket-side bore 12 are oriented perpendicular to one another, the biased pushrod 34 engages into the bore 12 of the socket. Therefore, the locking bolt 34 is located in the closed position, as shown in FIG. 4B. The spring 36 is compressed as long as the pushrod, i.e. an inner-side end 42 of the pushrod 34, lies against the outer wall of the mounting 17.

Figure 4A:
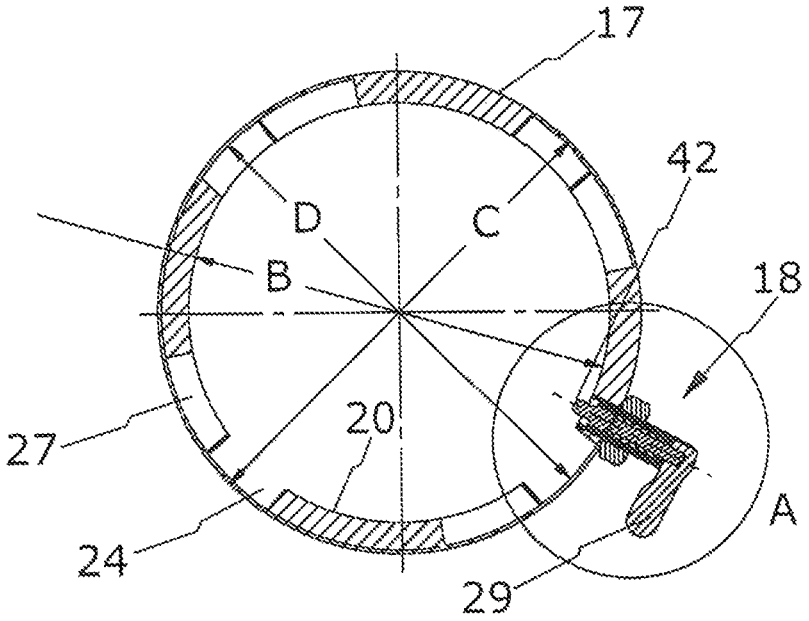
FIG. 4A shows a cross-section through the mounting, as in FIG. 3A, but with the locking bolt or pushrod of the securing device in the locked position.
Figure 4B:
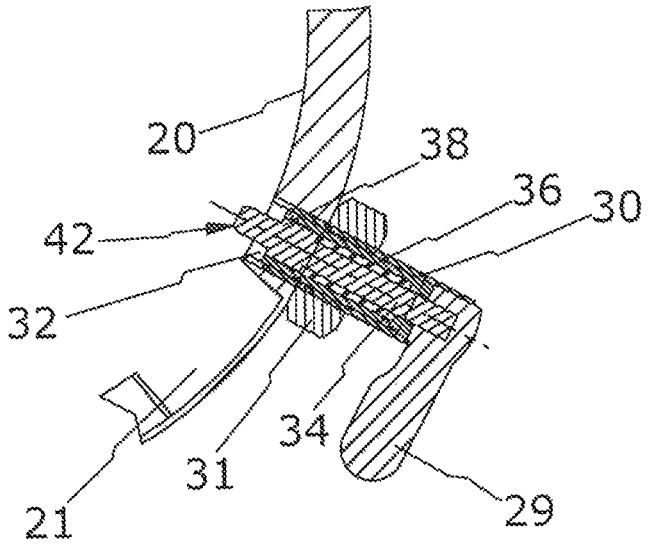
FIG. 4B shows an enlarged view of the securing device which is illustrated in FIG. 4A and is circled and marked by reference sign A.

FIG. 4A shows the closure pushrod 34 in the closed position, i.e. in the locked position. The pushrod 34 is located in this position in engagement with the socket-side bore 12 (not shown here). As can be seen in FIG. 4A, the inner-side end 42 of the pushrod 34 protrudes from the inner wall 20 of the mounting 17. The rotary vane or closure lever 29 is located in this position. The spring 36 is no longer biased after the pushrod 34 engages into the socket-side bore 12 which is oriented with the bore 32 of the mounting 17. The bead-like region 38 of the pushrod 34 terminates at its face side, facing towards the socket 10, with the end of the second sleeve 35 facing towards the socket 10. The inner end of the pushrod 42 is received in a positive-locking manner in the socket-side bore 12 (not shown here). The displaceability of the pushrod 34 is apparent in FIGS. 3A and 3B with FIGS. 4A and 4B.

FIG. 4B shows the pushrod 34 in the locking position. The lever 29 is in the first position. The spring 36 is deflected. The closure lever 29 is guided in the direction of the mounting 17 via the inclined ramp 40. The pushrod protrudes inwards on the inner side or inner wall 20 of the mounting 17, and moreover for engagement into the socket-side bore (not shown here).

Figure 5:
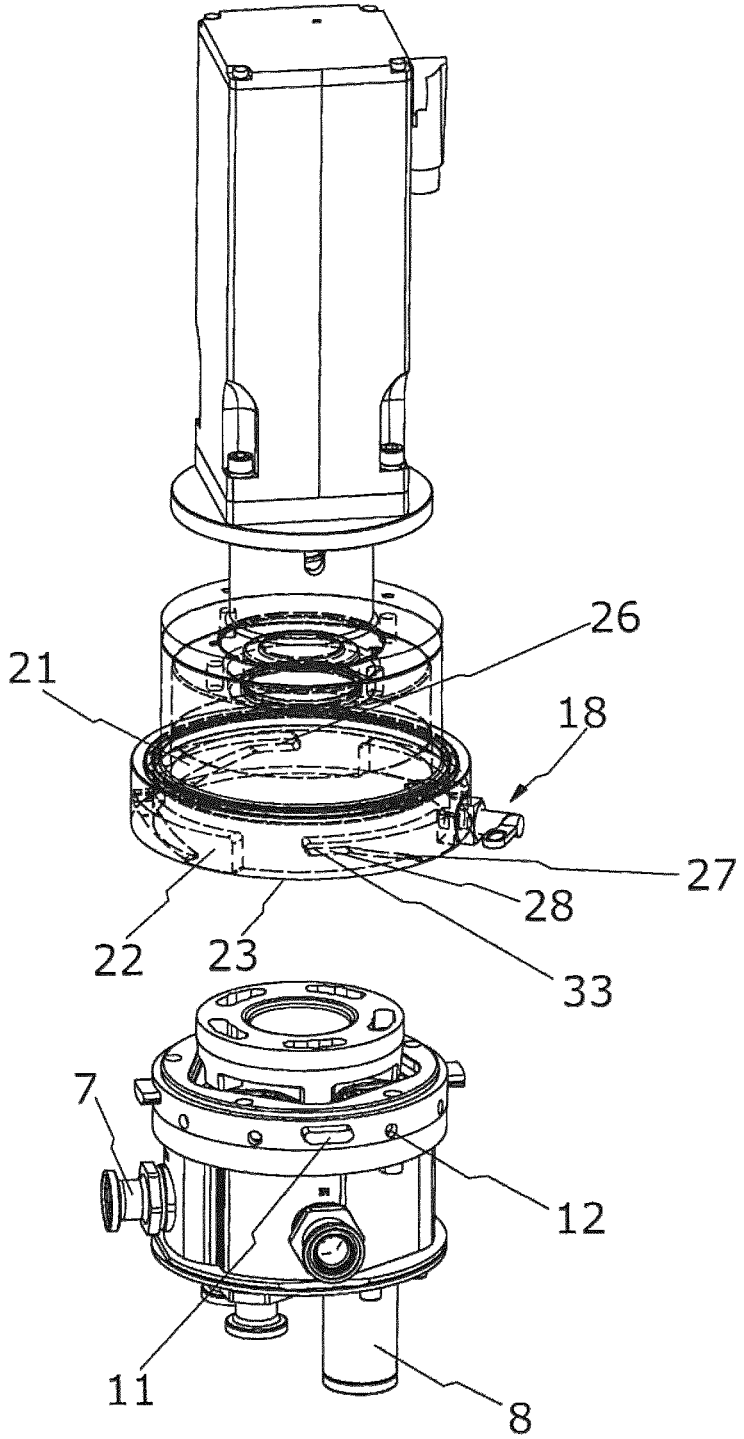
FIG. 5 shows a side view of the pump.

FIG. 5 is a side view of the pump head 2 and the pump drive 3, wherein the pump drive 3 is positioned relative to the pump head 2 such that the locking position, i.e. the closed position of the securing device, is shown during axial displacement along axis A of the pump head 2 towards the pump drive 3. The foremost latching lug 11 shown in the side view is received in the longitudinal slot 26 in the end position 33. However, the locking is then released as the closure lever 29 is located in the second position. Therefore, the closure lever 29 has been moved from the first position to the second position after locking, so that the pushrod 34 is retracted from the socket-side bore 12 by reason of the guidance of the lever 29 via the inclined ramp 27. A total of four socket-side bores 12 are provided on the pump head 2 close to the respective latching grooves 21. Therefore, the pushrod 34 of the one securing device 18 can be moved to the locking position in four positions of the pump drive 3 relative to the pump head 2. The connections 7 on the pump head housing 4 can thus be positioned in different positions relative to the drive.

LIST OF REFERENCE SIGNS

1 pump
2 pump head
3 pump drive
4 pump head housing
5 housing wall
6 bottom
7 connections
8 relief valve
9 housing ring
10 socket
11 latching lugs
12 socket-side bore
13 rounded face-side end of the latching lug
14 drive housing
15 flange
16 drive chamber housing
17 mounting
18 securing device
19 closure arrangement
20 inner wall
21 slot-like receptacles, latching grooves
22 transverse slot
23 mounting edge
24 insertion opening
25 bottom of the transverse slot
26 longitudinal slot
27 inclined surface, wedge surface
28 longitudinal side of the longitudinal slot closest to the mounting edge
29 lever, closure lever
30 first sleeve
21 nut
32 mounting-side bore
33 end position
34 pushrod, closure pushrod, locking bolt
35 second sleeve
36 spring
37 wall
38 thickened portion
39 stop
40 inclined ramp
41 outer end of the pushrod
42 inner-side end of the pushrod

The invention claimed is:

1. A diaphragm pump, comprising:
a pump head;
a pump drive; and
a socket formed on the pump head configured to be releasably fixed to a mounting formed on the pump drive via a rotary closure, wherein the rotary closure includes a securing device that includes a pushrod which is received in the mounting and is configured to be biased by a spring via a lever and engages in a positive-locking manner into a bore formed on the socket for locking;
wherein the pushrod is mounted in a first sleeve fastened in a vertical bore in the mounting and a second sleeve is provided in the first sleeve for accommodating the spring.

2. The diaphragm pump as claimed in claim 1, wherein the mounting includes at least two bayonet-like latching grooves and the socket includes at least two complementary latching lugs for engagement with the at least two bayonet latching grooves, such that the at least two complementary latching lugs are configured to be releasably fixed to the at least two bayonet latching grooves via a rotational movement after insertion into the mounting.

3. The diaphragm pump as claimed in claim 2, wherein the at least two bayonet latching grooves are arranged at a 180° angle to one another, and the at least two complementary latching lugs are arranged at a 180° angle to one another.

4. The diaphragm pump as claimed in claim 2, wherein the mounting includes at least four bayonet latching grooves, and wherein the socket includes at least four complementary latching lugs.

5. The diaphragm pump as claimed in claim 4, wherein the at least four bayonet latching grooves are arranged at a 90° angle to one another, and wherein the at least four complementary latching lugs are arranged at a 90° angle to one another.

6. The diaphragm pump as claimed in claim 2, wherein the at least two bayonet latching grooves are formed internally in the mounting and the complementary latching lugs are formed externally on the socket.

7. The diaphragm pump as claimed in claim 2, wherein each of the at least two bayonet latching grooves include a transverse slot and a longitudinal slot on an inner wall of the mounting, wherein the corresponding transverse slot extends perpendicularly to a circumference of the mounting and is open on a socket side to receive a respective lug of the at least two complementary latching lugs and is obliquely flattened on one side such that the respective lug of the at least two complementary latching lugs is configured to be guided into the corresponding longitudinal slot via an inclined surface.

8. The diaphragm pump as claimed in claim 2, wherein the at least two complementary latching lugs are elongated and are rounded on at least one of the face sides of the at least two complementary latching lugs to reduce a friction factor.

9. The diaphragm pump as claimed in claim 1, wherein a socket-side bore for the pushrod engagement is oriented with the pushrod in the mounting in an end position of the rotary closure.

10. The diaphragm pump as claimed in claim 1, wherein the first sleeve for receiving the pushrod has an inclined ramp such that the pushrod is configured to be biased to a first position by rotation of the lever provided on the outer end of the pushrod, and is configured to be released to a second position by counter-rotation, wherein the biased pushrod engages into the bore of the socket when the bore is oriented with the pushrod.

11. The diaphragm pump as claimed in claim 10, wherein the lever includes a rotary vane.

12. The diaphragm pump as claimed in claim 10, wherein the counter-rotation is 180°.

13. The diaphragm pump as claimed in claim 10, wherein the inclined ramp is formed by an inclined cut on the first sleeve protruding from the mounting.

14. The diaphragm pump as claimed in claim 1, wherein the pushrod latches out of a socket-side bore after rotation of the lever by 180°, from a first position to a second position, so that the locking is released.

15. The diaphragm pump as claimed in claim 1, wherein the securing device is arranged on the mounting at a spaced interval between at least two latching grooves.

16. The diaphragm pump as claimed in claim 1, wherein the bore is spaced between at least two latching lugs such that a spaced interval between the bore and one of the at least two latching lugs is at an angle of 1° to 44°.

17. The diaphragm pump of claim 16, wherein the angle is 5° to 30°.

18. The diaphragm pump as claimed in claim 1, wherein the rotary closure includes a bayonet closure.

19. A diaphragm pump, comprising:

a pump head;

a pump drive; and a socket formed on the pump head configured to be releasably fixed to a mounting formed on the pump drive via a rotary closure, wherein the rotary closure includes a securing device that includes a pushrod which is received in the mounting and is configured to be biased by a spring via a lever and engages in a positive-locking manner into a bore formed on the socket for locking;

wherein the socket includes at least two socket-side bores provided radially to an annular shaped surface of the socket.

20. The diaphragm pump of claim 19, wherein the socket includes at least four socket-side bores arranged at a 90° angle to one another provided radially to the annular shaped surface of the socket.

* * * * *